US010363742B2

(12) United States Patent
Maruyama et al.

(10) Patent No.: US 10,363,742 B2
(45) Date of Patent: Jul. 30, 2019

(54) LIQUID EJECTING APPARATUS

(71) Applicant: SEIKO EPSON CORPORATION, Tokyo (JP)

(72) Inventors: Akihiko Maruyama, Matsumoto (JP); Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/686,711

(22) Filed: Aug. 25, 2017

(65) Prior Publication Data

US 2018/0056652 A1 Mar. 1, 2018

(30) Foreign Application Priority Data

Aug. 29, 2016 (JP) ..... 2016-167224

(51) Int. Cl.

*B41J 2/175* (2006.01)
*B41J 2/14* (2006.01)
*B41J 29/13* (2006.01)

(52) U.S. Cl.

CPC ..... *B41J 2/1433* (2013.01); *B41J 2/175* (2013.01); *B41J 2/1752* (2013.01); *B41J 2/1753* (2013.01); *B41J 2/17509* (2013.01); *B41J 2/17513* (2013.01); *B41J 2/17553* (2013.01); *B41J 29/13* (2013.01); *B41J 2002/14419* (2013.01); *B41J 2002/14491* (2013.01)

(58) Field of Classification Search

CPC ..... B41J 2/1433; B41J 2/175; B41J 2/17509; B41J 2/17513; B41J 2/1752; B41J 2/1753; B41J 2/17553

See application file for complete search history.

(56) References Cited

U.S. PATENT DOCUMENTS

2009/0153629 A1* 6/2009 Yokouchi ..... B41J 2/17566 347/85
2012/0105519 A1* 5/2012 Urlaub ..... B41J 2/1752 347/5
2012/0206547 A1 8/2012 Shirotori
2016/0114588 A1* 4/2016 Nakamura ..... B41J 2/175 347/85

FOREIGN PATENT DOCUMENTS

JP 2005-096152 A 4/2005
JP 2012-166474 A 9/2012

* cited by examiner

*Primary Examiner* — Jason S Uhlenhake
(74) *Attorney, Agent, or Firm* — Workman Nydegger

(57) ABSTRACT

A liquid ejecting apparatus includes a liquid ejecting head which ejects liquid from nozzles; a liquid supply path which includes a liquid chamber partly formed of a flexible member, and supplies liquid to the liquid ejecting head; and a flow path unit which includes a displacement detecting unit which detects a displacement of the flexible member, and the liquid chamber, in which the flexible member closes the liquid supply path by being displaced in a direction in which a volume of the liquid chamber is reduced due to a decrease in liquid in the liquid chamber.

11 Claims, 11 Drawing Sheets

LIQUID EJECTING APPARATUS

BACKGROUND

The present invention relates to a liquid ejecting apparatus such as an ink jet printer, for example.

RELATED ART

In the related art, as an example of the liquid ejecting apparatus, there has been an ink jet printer which performs printing by ejecting ink (liquid) supplied from an ink tank to a recording medium from a recording head (liquid ejecting head). In addition, in such a printer, there has been a printer provided with a sub-tank (liquid chamber) which expands and contracts on an ink supply path (liquid supply path) supplies ink to the recording head from the ink tank (liquid accommodating unit), and which detects a residual quantity of ink in the ink tank according to a swelling state of the sub-tank (for example, JP-A-2005-96152).

Meanwhile, such a printer is provided with an ink supply valve which opens or closes the ink supply path on the upstream side from the sub-tank. For this reason, the ink supply path becomes complicated.

Such a problem is not limited to an ink jet printer provided with an ink supply path, and is generally common to a liquid ejecting apparatus provided with a liquid supply path.

SUMMARY

An advantage of some aspects of the invention is to provide a liquid ejecting apparatus in which it is possible to prevent a configuration of a liquid supply path from becoming complicated.

Hereinafter, means of the invention and operation effects thereof will be described.

According to an aspect of the invention, there is provided a liquid ejecting apparatus which includes a liquid ejecting head which ejects liquid from nozzles, a liquid supply path which includes a liquid chamber partly formed by a flexible member, and supplies the liquid to the liquid ejecting head, and a flow path unit which includes a displacement detecting unit which detects a displacement of the flexible member, and the liquid chamber, in which the flexible member closes the liquid supply path by being displaced in a direction in which a volume of the liquid chamber is reduced due to a decrease in the liquid in the liquid chamber.

According to the configuration, since the liquid supply path is closed by the flexible member which is a detecting target of the displacement detecting unit, and configures a part of the liquid chamber, it is possible to prevent a configuration of the liquid supply path from being complicated, compared to a case in which a configuration for closing the liquid supply path is separately provided.

In the liquid ejecting apparatus, it is preferable that the flow path unit further include a guided portion which is connected to the flexible member and displaced along with the flexible member, and a guide portion which guides the guided portion in a displacing direction of the flexible member.

According to the configuration, since the guided portion connected to the flexible member is guided in a displacing direction of the flexible member by the guide portion, it is possible to make a displacement of the flexible member stable. Accordingly, it is possible to stably close the liquid supply path using the flexible member.

In the liquid ejecting apparatus, it is preferable that the guided portion be provided in a shaft shape so as to protrude on the liquid chamber side from the flexible member, the guide portion be configured so that the guided portion is inserted into the guide portion, the flexible member have an annular closing portion at a position surrounding the guided portion, and the closing portion close the liquid supply path when the flexible member is displaced in a direction of reducing a volume of the liquid chamber, and comes into contact with the liquid supply path.

According to the configuration, the closing portion included in the flexible member closes the liquid supply path at a position of surrounding the guided portion. That is, since it is possible to determine a position for closing the liquid supply path, closing of the liquid supply path can be stably performed.

It is preferable that the liquid ejecting apparatus further include a suctioning unit which suctions the liquid from the liquid ejecting head, and the flow path unit further include a liquid sending unit which sends the liquid to the liquid ejecting head from a liquid accommodating unit on the upstream side from the liquid chamber, and the flexible member close the liquid supply path when the liquid is suctioned by the suctioning unit in a state in which the liquid sending unit is set to a non-driving state.

According to the configuration, it is possible to perform cleaning of the liquid ejecting head using the suctioning unit which suctions liquid from the liquid ejecting head. In addition, since it is possible to close the liquid supply path using the suctioning, it is possible to suppress an increase in the number of components compared to a case of separately providing a mechanism for closing the liquid supply path.

In the liquid ejecting apparatus, it is preferable that the flexible member open the liquid supply path when the liquid sending unit is driven in a state in which the liquid is suctioned by the suctioning unit, and the liquid supply path is closed.

According to the configuration, when liquid is suctioned by the suctioning unit, and the liquid supply path is closed, a negative pressure in the liquid supply path increases. In addition, when the liquid supply path is opened by driving the liquid sending unit in this state, liquid can be caused to flow with great force.

In the liquid ejecting apparatus, it is preferable that the flow path unit further include a connection portion which is connected to the liquid accommodating unit which accommodates the liquid supplied to the liquid ejecting head, and an engaging portion which is engaged with the liquid accommodating unit, and the connection portion and the engaging portion are respectively provided with respect to a plurality of liquid accommodating units.

According to the configuration, since the flow path unit includes the connection portion and the engaging portion, it is possible to make a structure of a mounting unit on which the liquid accommodating unit is mounted simple. For this reason, it is possible to cause a color of liquid to be accommodated, a quantity of liquid to be accommodated, or the like, to easily correspond to a liquid accommodating unit of a different type.

In the liquid ejecting apparatus, it is preferable that the flow path unit further include a substrate connection portion which is electrically connected to a circuit board of the liquid accommodating unit which accommodates the liquid supplied to the liquid ejecting head, and the substrate connection portion are respectively provided with respect to the plurality of liquid accommodating units.

According to the configuration, since the flow path unit includes the substrate connection portion which is connected to the circuit board of the liquid accommodating unit, it is possible to make a structure of the mounting unit on which the liquid accommodating unit is mounted simple. For this reason, it is possible to cause a color of liquid to be accommodated, a quantity of liquid to be accommodated, or the like, to easily correspond to a liquid accommodating unit of a different type.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of a liquid ejecting apparatus will be described with reference to drawings. The liquid ejecting apparatus is an ink jet printer which performs recording (printing) by ejecting ink as an example of liquid to a medium such as a sheet, for example.

Figure 1:
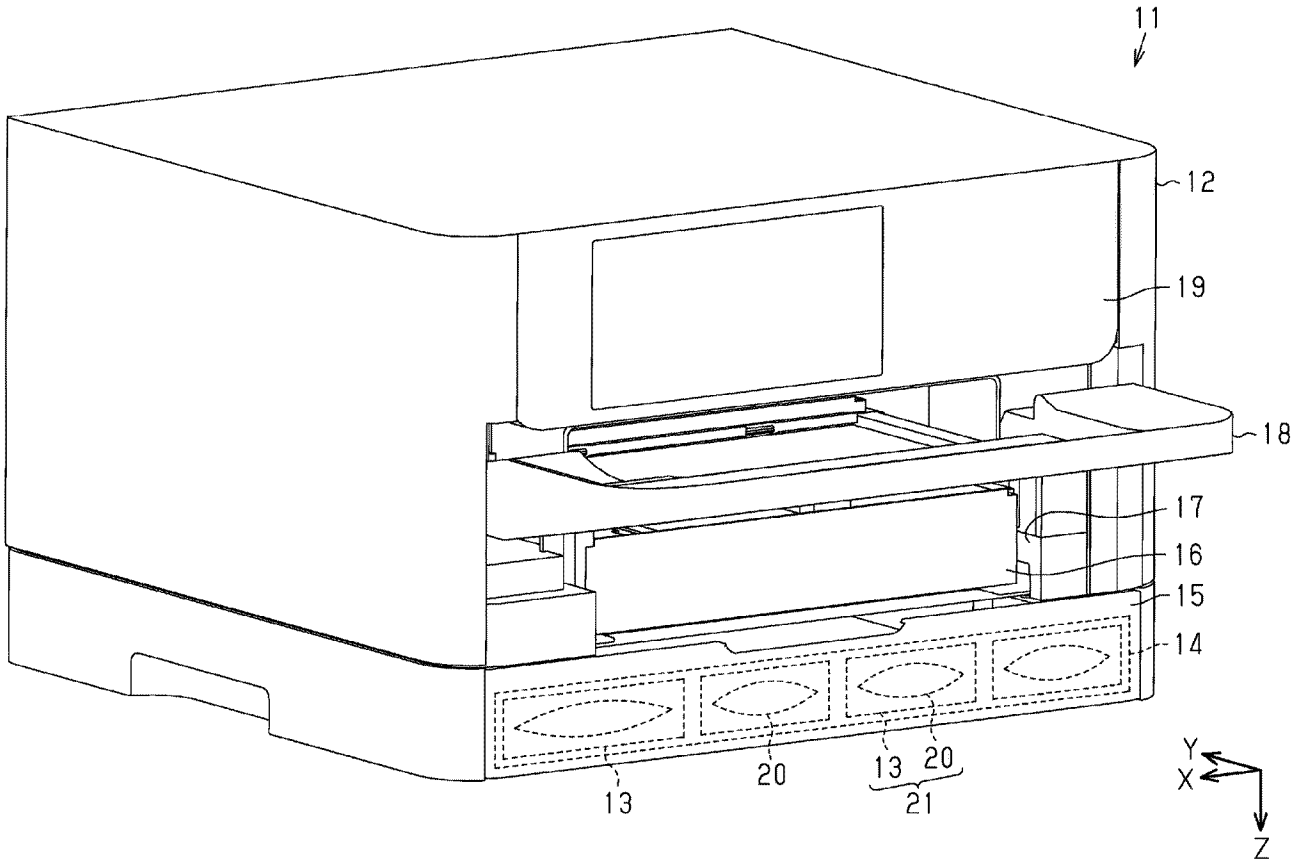
FIG. 1 is a perspective view of a liquid ejecting apparatus according to an embodiment.

As illustrated in FIG. 1, a liquid ejecting apparatus 11 is provided with an approximately a rectangular parallelepiped shaped exterior body 12. A rotatable front lid 15 which covers a mounting unit 14 on which a container 13 is detachably mounted, and a mounting port 17 on which a medium accommodating body 16 which can accommodate a medium S (refer to FIG. 2) is mounted are disposed upward in order from a base portion side, at a front face portion of the exterior body 12. In addition, a discharging tray 18 from which the medium S is discharged, and an operation panel 19 for operating the liquid ejecting apparatus 11 are disposed above the mounting port 17. The front face of the exterior body 12 is a side face with a height and a width, and in which an operation with respect to the liquid ejecting apparatus 11 is mainly performed.

One or a plurality of (four in embodiment) containers 13 can be mounted on the mounting unit 14 in the embodiment. A liquid accommodating body 20 can be detachably mounted in these containers 13. In addition, in the embodiment, a liquid accommodating unit 21 is formed of the container 13, and the liquid accommodating body 20 mounted in the container 13.

The liquid accommodating bodies 20 accommodate liquid of different types (for example, ink of different color such as black, cyan, magenta, yellow), respectively. In addition, the container 13 is detachably mounted on the mounting unit 14 even in a state of a single body which does not hold the liquid accommodating body 20, and is a constituent element provided in the liquid ejecting apparatus 11.

In the embodiment, a direction intersecting (orthogonal, preferably) a movement path of the container 13 when being mounted on the mounting unit 14 is a width direction, and a direction in which the movement path extends is a depth direction. The width direction and the depth direction substantially go along a horizontal plane. In drawings, a direction of gravity is denoted by a Z axis by assuming that the exterior body 12 is placed on the horizontal plane, and a movement direction of the container 13 when being mounted on the mounting unit 14 is denoted by a Y axis. There is a case in which the movement direction is also written as a mounting direction on the mounting unit 14 or an inserting direction to an accommodating space, and a direction opposite to the movement direction is written as an extracting direction. In addition, the width direction is denoted by an X axis which is orthogonal to the Z axis and the Y axis. That is, the width direction, the direction of gravity, and the mounting direction intersect (orthogonal, preferably) each other, and become directions in a case of writing lengths of a width, a height, and a depth, respectively.

Figure 2:
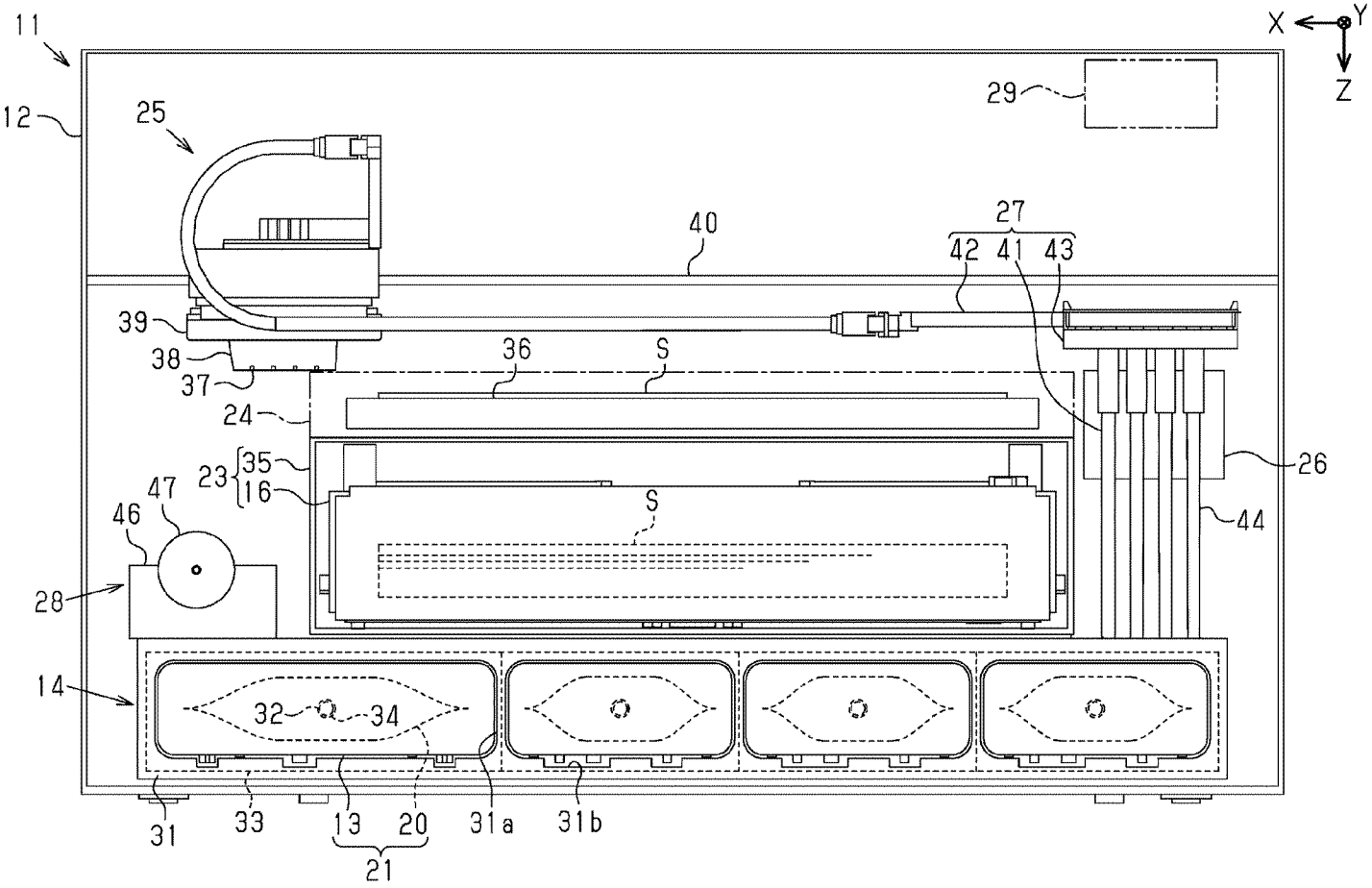
FIG. 2 is a front view which illustrates an internal structure of the liquid ejecting apparatus in FIG. 1.

As illustrated in FIG. 2, the mounting unit 14, a medium accommodating unit 23, a transport unit 24, and a recording unit 25 are accommodated in the exterior body 12 in order from a base portion toward a higher portion. In addition, the liquid ejecting apparatus 11 is provided with a maintenance unit 26 for performing maintenance of the recording unit 25, a liquid supply flow path 27 supplies liquid to the recording unit 25, a supply mechanism 28 which sends liquid accommodated in the liquid accommodating unit 21 to the liquid supply flow path 27, and a control unit 29 which controls an operation of the recording unit 25, and the like.

Figure 3:
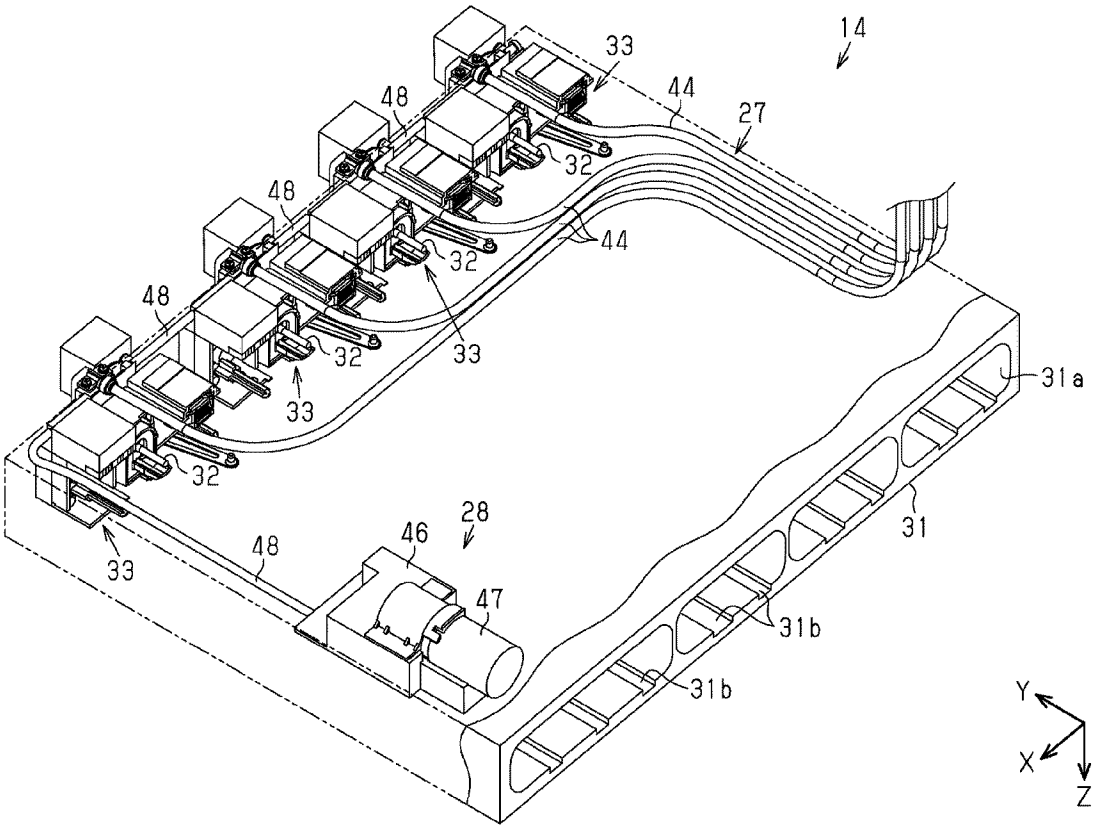
FIG. 3 is a perspective view of a mounting unit provided in the liquid ejecting apparatus in FIG. 1.

As illustrated in FIGS. 2 and 3, the mounting unit 14 includes a frame body 31 which forms an accommodating space which can accommodate the liquid accommodating unit 21. The frame body 31 forms an inserting port 31*a* which communicates with the accommodating space from a near side. In addition, it is preferable that the frame body 31 include a plurality of sets of linear guiding rails 31*b* formed in one, or two or more protrusion shapes or recessed shapes which extend in the depth direction in order to guide a movement of the liquid accommodating unit 21 when being detached. The liquid accommodating unit 21 enters the accommodating space through the inserting port 31*a*, moves in the depth direction along a movement path which extends toward the depth side, and is mounted on the mounting unit 14.

A flow path unit 33 including a connection portion 32 formed in a hollow pin shape is provided on the depth side of the accommodating space formed by the frame body 31. When the liquid accommodating unit 21 is mounted on the mounting unit 14, a supply port 34 (refer to FIG. 2) and the connection portion 32 included in the liquid accommodating unit 21 are connected, and it enters a state in which liquid accommodated in the liquid accommodating unit 21 can be supplied to the liquid ejecting apparatus 11 through the connection portion 32. In addition, a plurality (four in embodiment) of the flow path units 33 in the embodiment are provided so as to correspond to a plurality of (four in embodiment) the liquid accommodating units 21 mounted on the liquid ejecting apparatus 11, respectively.

As illustrated in FIG. 2, the medium accommodating unit 23 includes a medium accommodating body 16 of a drawer type which accommodates the medium S, and a guide frame 35 which guides a movement of the medium accommodating body 16.

The transport unit 24 includes a medium support unit 36 which supports the medium S. The transport unit 24 transports the medium S accommodated in the medium accommodating unit 23, by taking out the medium from the medium accommodating unit 23 sheet by sheet, and dispose the medium on the medium support unit 36.

The recording unit 25 is provided with a liquid ejecting head 38 which ejects liquid from the nozzle 37, and a carriage 39 which holds the liquid ejecting head 38. A guide shaft 40 which extends in the width direction is installed inside the exterior body 12. The carriage 39 reciprocates in the width direction along the guide shaft 40, and printing is performed when the liquid ejecting head 38 ejects liquid to the medium S on the medium support unit 36 in the middle of reciprocating of the carriage.

The liquid supply flow path 27 is a flow path for supplying liquid to the liquid ejecting head 38 from the liquid accommodating unit 21, and at least one (four in embodiment) liquid supply path is provided in each type of liquid (color in embodiment). That is, liquid supplied to the liquid ejecting head 38 is accommodated in the liquid accommodating unit 21.

It is preferable that the liquid supply flow path 27 include a flow path on upstream side 41, a flow path on downstream side 42, and a connection flow path 43 which connects the flow path on upstream side 41 and the flow path on downstream side 42. In addition, the flow path on upstream side 41 includes the flow path unit 33 and a flexible supply tube 44.

As illustrated in FIG. 3, the supply mechanism 28 is provided with a pressure changing mechanism 46 and a driving source 47 of the pressure changing mechanism 46, and a pressure changing flow path 48 which connects the flow path unit 33 and the pressure changing mechanism 46.

Figure 4:
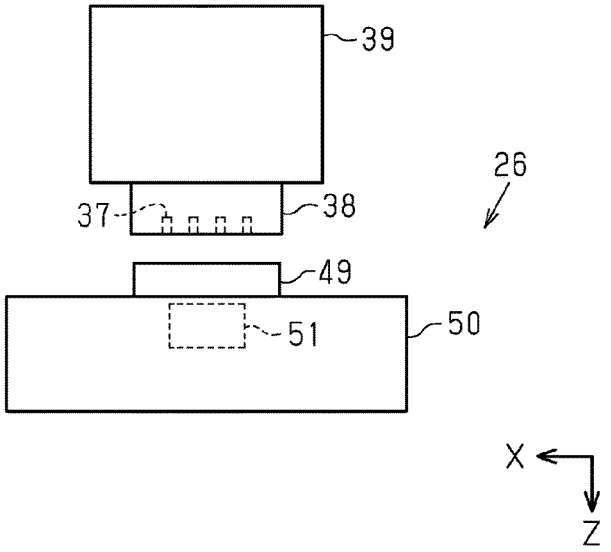
FIG. 4 is a schematic view of a maintenance unit provided in the liquid ejecting apparatus in FIG. 1.

As illustrated in FIG. 4, the maintenance unit 26 is provided with a bottomed box-shaped cap 49 which is formed in a size corresponding to the liquid ejecting head 38, an elevating mechanism 50 for moving the cap 49 in an elevating manner, and a suctioning unit 51 for suctioning the inside of the cap 49.

The cap 49 forms a closed spatial area between the cap and a lower face side to which the nozzle 37 of the liquid ejecting head 38 opens in a surrounding manner, by coming into contact with the liquid ejecting head 38 so as to surround an opening of the nozzle 37, by moving in a lifting manner. In addition, suctioning cleaning in which liquid in the liquid ejecting head 38 is discharged through the nozzle 37 is performed, by causing a negative pressure in the closed spatial area by driving the suctioning unit 51 in this state. That is, the suctioning unit 51 suctions liquid from the liquid ejecting head 38.

Subsequently, an external configuration of the flow path unit 33 will be described in detail.

Figure 5:
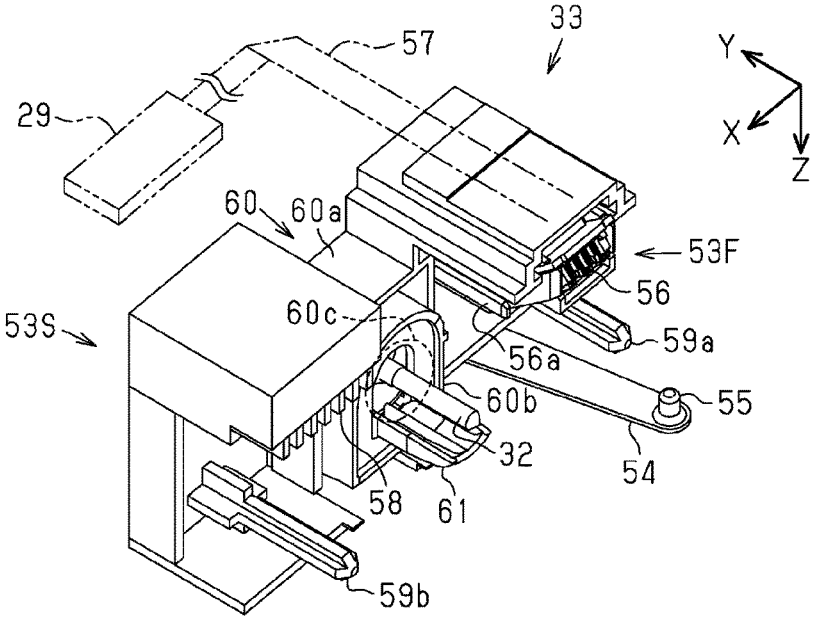
FIG. 5 is a perspective view of a flow path unit provided in the liquid ejecting apparatus in FIG. 1.

As illustrated in FIG. 5, the flow path unit 33 includes a first connecting mechanism 53F and a second connecting mechanism 53S, respectively, on both sides interposing the connection portion 32 in the width direction. The first connecting mechanism 53F is provided with an arm 54 which protrudes in an extracting direction on the vertically lower side of the connection portion 32, and an engaging portion 55 which is engaged with the liquid accommodating unit 21 is provided at a tip end of the arm 54. The arm 54 is configured so that a tip end side can rotate around a base end side. The engaging portion 55 protrudes upward, vertically, or the like, from the arm 45, for example, and is disposed on a movement path of the liquid accommodating unit 21 when being mounted on the mounting unit 14 (refer to FIG. 3).

In addition, the first connecting mechanism 53F is provided with a substrate connection portion 56 which is disposed upward vertically, compared to the connection portion 32, and protrudes in the extracting direction. The substrate connection portion 56 is connected to the control unit 29 through electric wiring 57 such as a flat cable. It is preferable that a higher end of the substrate connection portion 56 protrudes in an extracting direction compared to a lower end, and is disposed so as to face downward diagonally. In addition, it is preferable that a pair of guiding protrusion portions 56*a* which protrudes in the width direction, and extends along a mounting direction is disposed on both sides of the substrate connection portion 56 in the width direction.

It is preferable that the second connecting mechanism 53S be provided with a block 58 for preventing an erroneous insertion which protrudes in the extracting direction on the vertically higher side of the connection portion 32. The block 58 is formed in an uneven shape which is disposed by facing downward, and the uneven shape is different in each flow path unit 33.

The flow path unit 33 is provided with a pair of positioning protrusion portions 59*a* and 59*b*, an extrusion mechanism 60 which is disposed so as to surround the connection portion 32, and a liquid receiving portion 61 which protrudes in the extracting direction on the lower side of the connection portion 32. The pair of positioning protrusion portions 59*a* and 59*b* are aligned in the width direction by interposing the connection portion 32 therebetween so as to be included in the first connecting mechanism 53F and the second connecting mechanism 53S, respectively. The positioning protrusion portions 59*a* and 59*b* can be set to a bar-shaped protrusion portion which protrudes in the extracting direction by being in parallel to each other, for example. It is preferable that a protruding length of the positioning protrusion portions 59*a* and 59*b* in the extracting direction be longer than a protruding length of the connection portion 32 in the extracting direction.

The extrusion mechanism 60 is provided with a frame member 60*a* which surrounds a base end portion of the connection portion 32, an extrusion portion 60*b* which protrudes in an extracting direction from the frame member 60*a*, and an urging portion 60*c* which urges the liquid accommodating unit 21 in the extracting direction through the extrusion portion 60*b*. The urging portion 60*c* can be set to a coil spring which is interposed between the frame member 60*a* and the extrusion portion 60*b*, for example.

Subsequently, the liquid accommodating unit 21 mounted on the mounting unit 14 will be described.

Figure 6:
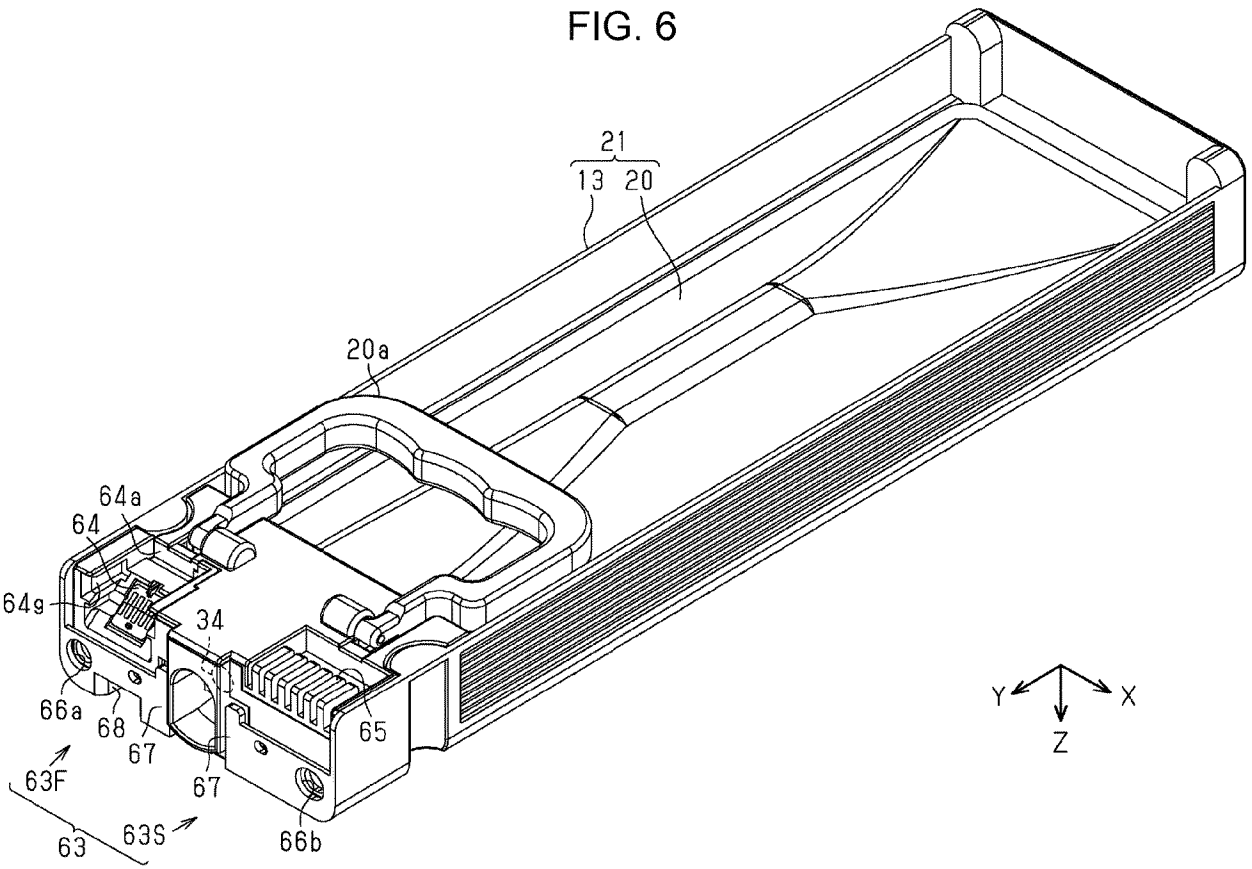
FIG. 6 is a perspective view of a liquid accommodating unit mounted on the liquid ejecting apparatus in FIG. 1.

As illustrated in FIG. 6, the liquid accommodating unit 21 is provided with the container 13 which has an external form of an approximately rectangular parallelepiped shape, and the liquid accommodating body 20 which can be detachable from the container 13, and the liquid accommodating body 20 is provided with a handle portion 20*a* which is gripped by a user when being detached from the container 13.

The liquid accommodating unit 21 is provided with a connection structure 63 at a tip end portion when setting a side which goes forward when being mounted on the mounting unit 14 (refer to FIG. 3) to a tip end, and setting an end on a side opposite to the tip end to a base end. The connection structure 63 includes a first connection structure 63F and a second connection structure 63S, respectively, on both sides in the width direction in which the supply port 34 is interposed therebetween.

The first connection structure 63F is provided with a circuit board 64 which is disposed vertically upward compared to the supply port 34. The circuit board 64 includes a storage unit which stores various information (for example, type of liquid accommodating body 20, accommodating quantity of liquid, or the like) related to the liquid accommodating body 20. In addition, the circuit board 64 includes a connecting terminal which is electrically connected to the substrate connection portion 56 included in the flow path unit 33.

It is preferable that the circuit board 64 is disposed in a recessed portion 64*a* which is provided in a form of being opened to a higher part and in a mounting direction, in a posture of facing upward, diagonally. In addition, it is preferable that a guiding recessed portion 64*g* which extends in a mounting direction be disposed on both sides of the circuit board 64 in the width direction.

It is preferable that the second connection structure 63S be provided with an identification portion 65 for preventing an erroneous insertion which is disposed vertically upward compared to the supply port 34. The identification portion 65 has an uneven portion formed in a shape of being fitted to the block 58 (refer to FIG. 5) of the flow path unit 33 which is correlated so as to be connected.

The connection structure 63 is provided with a pair of positioning holes 66*a* and 66*b*, and an urge receiving portion 67 which receives an urging force of the urging portion 60*c* (refer to FIG. 5). The positioning holes 66*a* and 66*b* are aligned in the width direction by interposing the supply port 34 therebetween so as to be included in the first connection structure 63F and the second connection structure 63S, respectively. It is preferable that the first positioning hole 66*a* included in the first connection structure 63F be set to a circular hole; however, the second positioning hole 66*b* included in the second connection structure 63S be set to a long hole formed in an oval shape which is long in the width direction.

Subsequently, a connection of the connection structure 63 provided in the liquid accommodating unit 21 to the flow path unit 33 will be described.

As illustrated in FIGS. 5 and 6, when the liquid accommodating unit 21 is inserted into the accommodating space, and of which a tip end gets close to the flow path unit 33, first, tip ends of the positioning protrusion portions 59*a* and 59*b* of which a protruding length in the extracting direction is long are engaged with the positioning holes 66*a* and 66*b* of the liquid accommodating unit 21 in an entering form, and a movement of the liquid accommodating unit 21 in the width direction is regulated. Since the second positioning hole 66*b* corresponding to the second positioning protrusion portion 59*b* is an oval-shaped long hole which extends in the width direction, the first positioning protrusion portion 59*a* which enters the circular first positioning hole 66*a* becomes a standard in positioning.

When the positioning protrusion portions 59*a* and 59*b* are engaged with the positioning holes 66*a* and 66*b*, and the liquid accommodating unit 21 proceeds to the depth side thereafter, the urge receiving portion 67 receives an urging force of the urging portion 60*c* by being in contact with the extrusion portion 60*b*, and the supply port 34 of the liquid accommodating unit 21 is connected to the connection portion 32. In this manner, it is preferable that the positioning protrusion portions 59*a* and 59*b* position the liquid accommodating unit 21 before the connection portion 32 is connected to the supply port 34.

In a case in which the liquid accommodating unit 21 is inserted into a correct position, the identification portion 65 is appropriately fitted to the block 58 of the flow path unit 33. In contrast to this, the identification portion 65 is not fitted to the block 58 in a case in which the liquid accommodating unit 21 is going to be mounted on a wrong position, it is not possible for the liquid accommodating unit 21 to further proceed to the depth side, and it is possible to prevent an erroneous mounting.

When the liquid accommodating unit 21 proceeds in the mounting direction, the substrate connection portion 56 enters inside the recessed portion 64*a* of the liquid accommodating unit 21, a position of the substrate connection portion 56 is adjusted when the guiding recessed portion 64*g* is guided by the guiding protrusion portion 56*a*, and the substrate connection portion comes into contact with the circuit board 64. In this manner, the circuit board 64 is electrically connected to the substrate connection portion 56, and an exchange of information is performed between the circuit board 64 and the control unit 29. In this manner, it is preferable to dispose the first positioning hole 66*a* as a standard of positioning on the side of the first connection structure 63F including the circuit board 64, between the first connection structure 63F and the second connection structure 63S.

When the supply port 34 of the liquid accommodating unit 21 is connected to the connection portion 32 so as to be able to supply liquid, and the circuit board 64 is electrically connected to the substrate connection portion 56 by being in contact therewith, a connection of the connection structure 63 to the flow path unit 33 is completed.

Subsequently, a structure for attaching or detaching of the liquid accommodating unit 21 with respect to the mounting unit 14 will be described.

Figure 7:
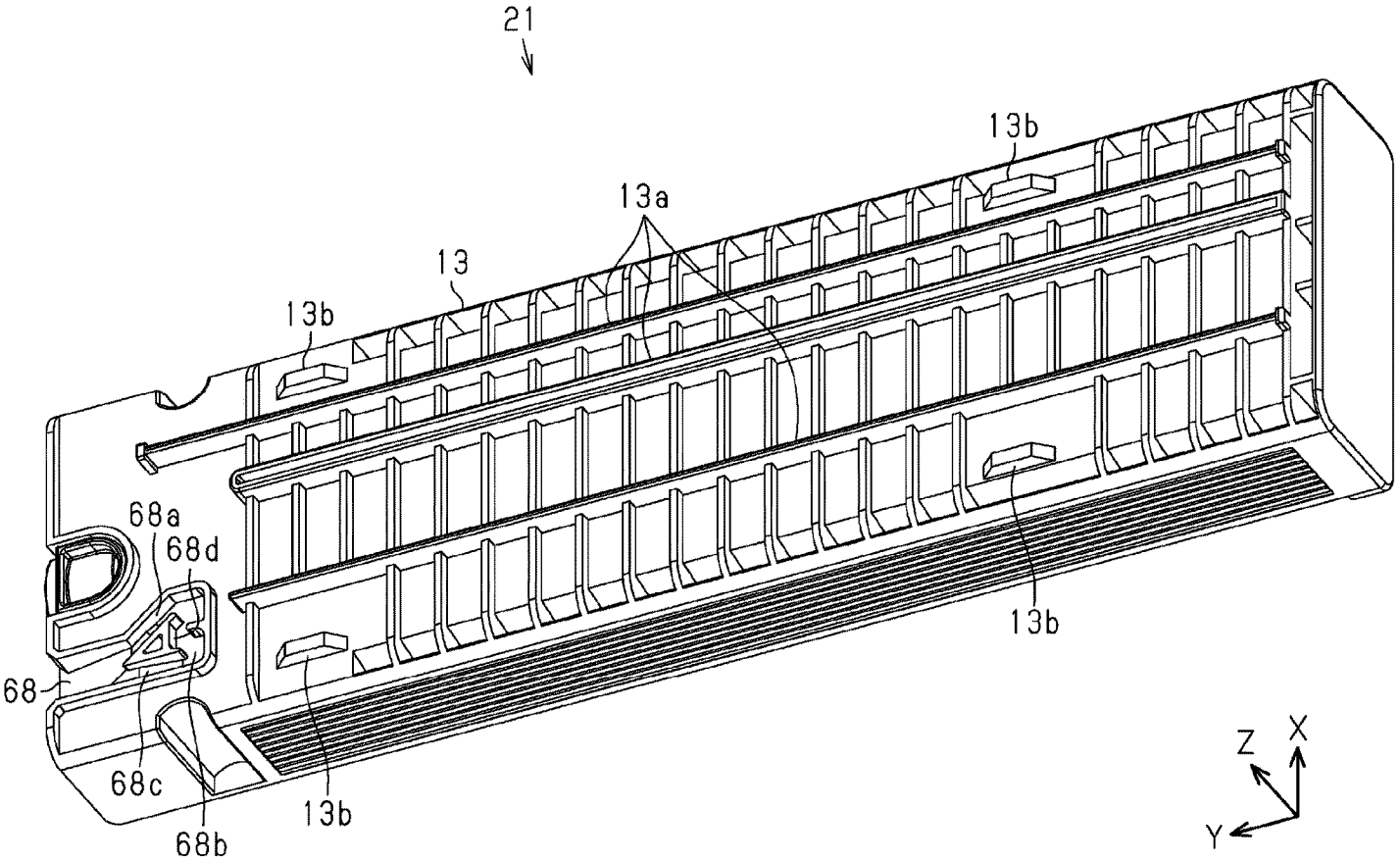
FIG. 7 is a perspective view when viewing the liquid accommodating unit in FIG. 6 from a different angle.

As illustrated in FIG. 7, an engaging groove 68 which extends from a tip end toward the extracting direction is provided on the bottom face of the container 13 in a recessed manner. It is preferable that the engaging groove 68 configure the connection structure 63, and be included on the first connection structure 63F side between the first connection structure 63F and the second connection structure 63S, similarly to the first positioning hole 66*a* as the standard of positioning.

The engaging groove 68 can be set to a heart shaped cam groove which includes a first inclined groove 68*a* which extends toward the extracting direction from a tip end on a bottom face, a locking groove 68*b* which extends in the width direction from a terminal end of the first inclined groove 68*a*, and a second inclined groove 68*c* which extends from a terminal end of the locking groove 68*b* toward a starting end of the first inclined groove 68*a*. In addition, when the container 13 or the liquid accommodating unit 21 gets close to a terminal end of a movement path at a time of being mounted on the mounting unit 14, the engaging portion 55 which protrudes at a tip end of the arm 54 is engaged with the engaging groove 68.

Here, the first inclined groove 68*a*, the locking groove 68*b*, and the second inclined groove 68*c* are inclined so that the grooves become shallow from a starting end toward a terminal end, respectively, and there is a level difference in each intersecting portion. For this reason, when the liquid accommodating unit 21 moves along the mounting direction after the engaging portion 55 is engaged with a starting end of the first inclined groove 68*a*, the engaging portion 55 is engaged with the first inclined groove 68*a*, the locking groove 68*b*, and the second inclined groove 68*c* in this order along the inclination, and there is no case in which the engaging portion 55 returns to the first inclined groove 68*a* from the locking groove 68*b*, or returns to the locking groove 68*b* from the second inclined groove 68*c*.

A portion of the locking groove 68*b* between a starting end and a terminal end is formed in a shape which is bent toward a tip end side, and the locking groove includes an engaging wall portion 68*d* which is located on the depth side in the mounting direction of the engaging portion 55, and is engaged with the engaging portion 55 at the bent portion. In addition, when the engaging portion 55 is engaged with the engaging wall portion 68*d*, a movement of the liquid accommodating unit 21 in the extracting direction is regulated while receiving an urging force of the urging portion 60*c*, and a state of the liquid accommodating unit mounted on the mounting unit 14 is maintained.

When the liquid accommodating unit 21 is engaged with the engaging portion 55, mounting of the liquid accommodating unit 21 on the mounting unit 14 is completed. In addition, since an engaging target of the engaging portion 55 is the container 13, it is also possible to mount the container 13 on the mounting unit 14 even in a case of a single body, not only the liquid accommodating unit 21.

Meanwhile, when the liquid accommodating unit 21 inserted into the accommodating space is pushed in the mounting direction by a user, and the engaging portion 55 relatively moves along the first inclined groove 68*a* by being engaged with the engaging groove 68, the liquid accommodating unit 21 receives an urging force of the urging portion 60*c*. For this reason, the liquid accommodating unit 21 slightly moves in the extracting direction using the urging force of the urging portion 60*c* between proceeding of the engaging portion 55 from the first inclined groove 68*a* to the locking groove 68*b* and engaging with the engaging wall portion 68*d*.

By setting so that there is a touching sound (clicking sound) when the engaging portion 55 comes into contact with the engaging wall portion 68*d*, or the like, at a terminal end of a movement path in the extracting direction, it is possible to give a user a sense or a feeling (clicking feeling) that mounting on the liquid accommodating unit 21 is completed. In this manner, it is possible to suppress an occurrence of a mounting failure which is caused by an incomplete insertion, or the like, of the liquid accommodating unit 21.

When the liquid accommodating unit 21 is pushed in the mounting direction by a user at a time in which the engaging portion 55 is engaged with the engaging wall portion 68*d*, the engaging portion 55 proceeds to the second inclined groove 68*c* along the inclination of the locking groove 68*b*, moves toward a terminal end of the second inclined groove 68*c* due to an urging force of the urging portion 60*c* while going along the inclination of the second inclined groove 68*c*, subsequently, and the engaging portion is disengaged from the engaging groove 68. Then, the liquid accommodating unit 21 moves in the extracting direction due to an urging force of the urging portion 60*c*, and a base end portion of the liquid accommodating unit 21 goes out of the frame body 31 and the exterior body 12 from the insertion port 31*a*. At this time, the supply port 34 is separated from the connection portion 32, the circuit board 64 is separated from the substrate connection portion 56, and mounting of the liquid accommodating unit 21 on the mounting unit 14 is released.

In addition, as illustrated in FIG. 7, it is preferable to provide a rail engaging portion 13*a* which goes along the unevenness of the guiding rail 31*b* (refer to FIG. 2) in a base portion of the container 13. Due to the guiding rail 31*b*, it is possible to make a movement path of the liquid accommodating unit 21 clear when being mounted on the mounting unit 14, and even in a case of inserting a plurality of liquid accommodating units 21 into one accommodating space, it is possible to move liquid accommodating units 21 which align by being adjacent to each other without causing them to be in contact unnecessarily.

In addition, it is preferable to provide three or more (four in embodiment) leg portions 13*b* which horizontally hold a posture of the container 13 at the base portion of the container 13. In this manner, it is possible to appropriately connect the liquid accommodating unit 21 and the connection portion 32, since the liquid accommodating unit 21 can be positioned in the vertical direction. In addition, it is possible to appropriately maintain the connection between the liquid accommodating unit 21 and the connection portion 32, since a posture of the liquid accommodating unit 21 can be correctly held.

Subsequently, an internal structure of the flow path unit 33 will be described.

Figure 8:
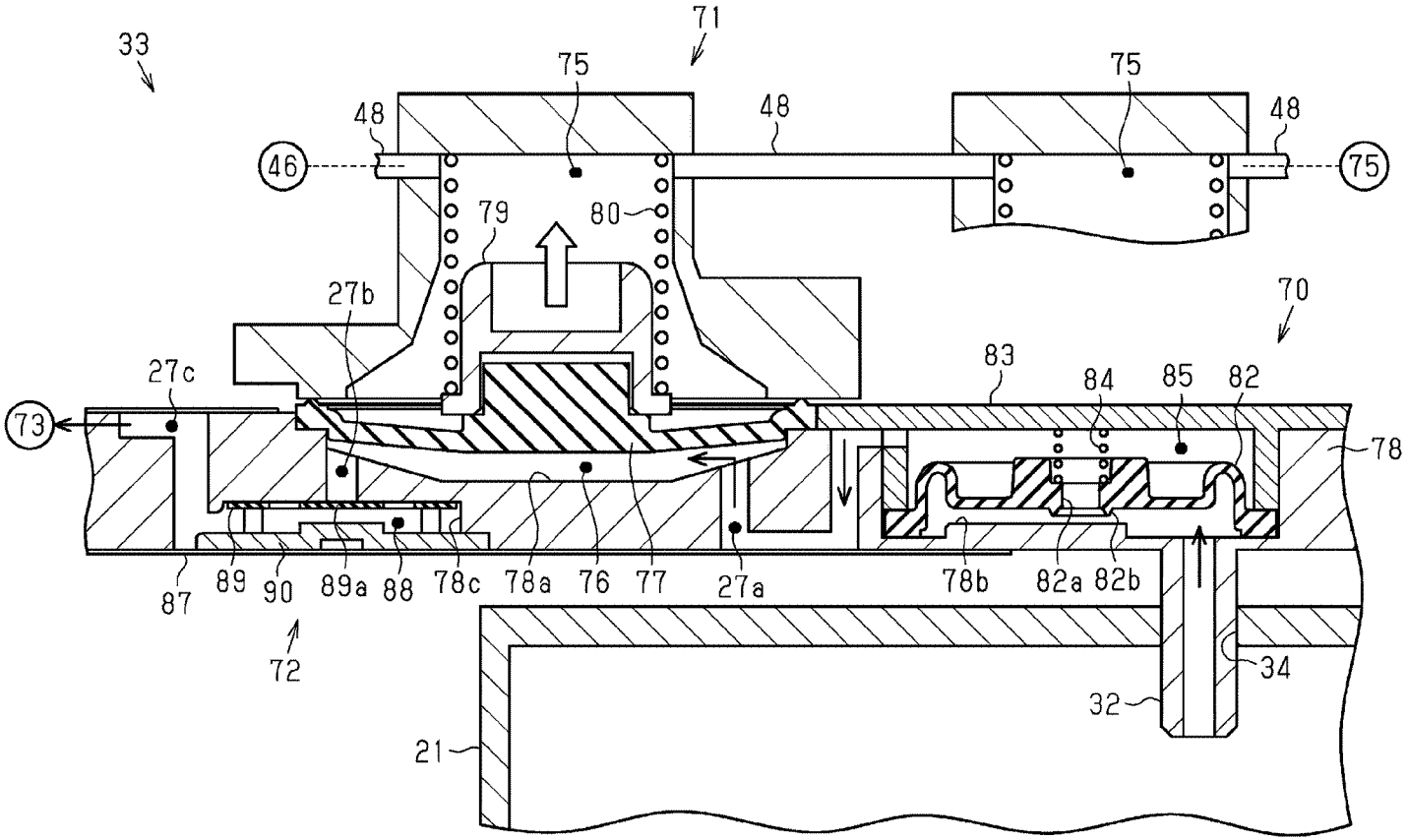
FIG. 8 is a schematic view which illustrates an internal configuration of the flow path unit in FIG. 5 when performing a suctioning operation.

As illustrated in FIG. 8, the flow path unit 33 includes an one-way valve on suctioning side 70, a liquid sending unit 71, an one-way valve 72 on ejecting side, and a buffer 73 in order from the connection portion 32 side as an upstream end of the liquid supply flow path 27 (refer to FIG. 2), and liquid is supplied to the supply tube 44 (refer to FIG. 3) from the buffer 73. The liquid sending unit 71 in the embodiment is a diaphragm pump which performs a suctioning operation of suctioning liquid accommodated in the liquid accommodating unit 21, and an ejecting operation of ejecting the suctioned liquid to the liquid ejecting head 38 side.

The one-way valve on suctioning side 70 and the liquid sending unit 71 communicate with each other through a first flow path 27*a*, and the liquid sending unit 71 and the one-way valve on ejecting side 72 communicate with each other through a second flow path 27*b*. In addition, the one-way valve on ejecting side 72 and the buffer 73 communicate with each other through a third flow path 27*c*, and the buffer 73 and the supply tube 44 communicate with each other through a fourth flow path 27*d* (refer to FIG. 10). The first flow path 27*a* to the fourth flow path 27*d* configure a part of the liquid supply flow path 27.

Subsequently, a configuration and an operation of the liquid sending unit 71 will be described.

As illustrated in FIG. 8, the liquid sending unit 71 is provided with a pressure changing chamber 75 to which a pressure changing flow path 48 is connected, a liquid sending chamber 76 which configures a part of the liquid supply flow path 27, and a diaphragm 77 which partitions the pressure changing chamber 75 and the liquid sending chamber 76. The flow path unit 33 in the embodiment includes a flow path forming member 78 in which a recessed portion for sending liquid 78*a* is formed. In addition, the liquid sending chamber 76 is formed in a surrounding manner by the recessed portion for sending liquid 78*a* and the diaphragm 77, and a downstream end of the first flow path 27*a* and an upstream end of the second flow path 27*b* are connected.

As illustrated in FIGS. 8 and 3, the liquid sending units 71 which are respectively provided in the plurality of flow path units 33 are connected in series using the pressure changing flow path 48. That is, a liquid sending unit 71 of one flow path unit 33 in the plurality of flow path units 33 is connected to the pressure changing mechanism 46 through the pressure changing flow path 48. In addition, pressure changing chambers 75 of flow path units 33 which are adjacent to each other in the width direction are connected to another flow path unit 33 through the pressure changing flow path 48. By connecting the pressure changing chamber 75 in this manner, in a case of changing a disposal interval of the flow path unit 33, for example, it is possible to easily correspond by giving flexibility to the pressure changing flow path 48, or replacing the pressure changing flow path 48 with a pressure changing flow path with a different length. In addition, when the supply mechanism 28 is driven, each pressure changing chamber 75 enters a negative pressure state.

As illustrated in FIG. 8, a spring seat 79 which is displaced along with the diaphragm 77, a first coil spring 80 which urges the diaphragm 77 toward the liquid sending chamber 76 side are accommodated in the pressure changing chamber 75. In addition, when a negative pressure is generated in the pressure changing chamber 75 along with driving of the supply mechanism 28, the liquid sending unit 71 performs a suctioning operation, since the diaphragm 77 is displaced in a direction of increasing a volume of the liquid sending chamber 76 against an urging force of the first coil spring 80.

Figure 9:
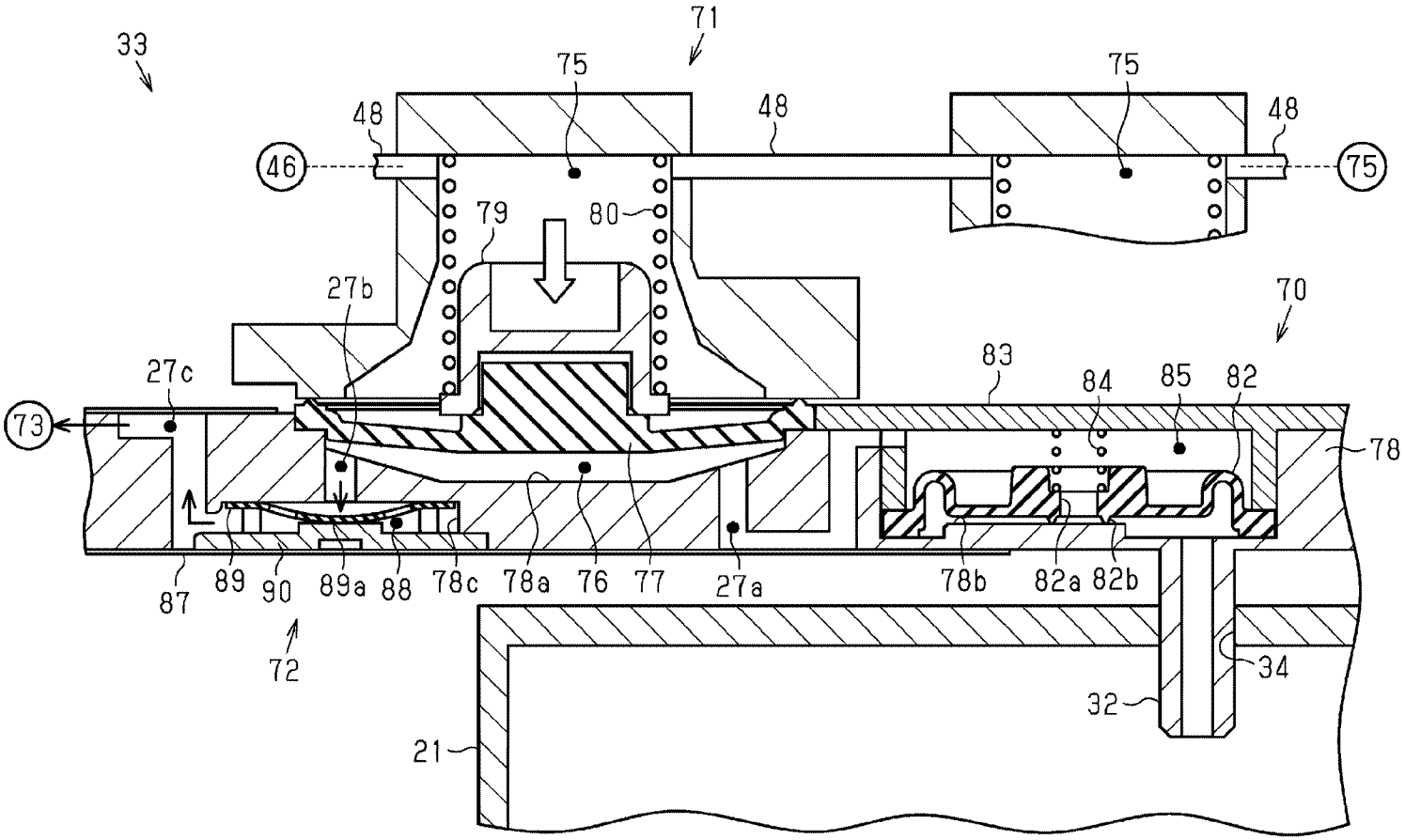
FIG. 9 is a schematic view which illustrates an internal configuration of the flow path unit in FIG. 5 when performing an ejecting operation.

In addition, as illustrated in FIG. 9, when the supply mechanism 28 opens the inside of the pressure changing chamber 75 to atmosphere after the suctioning operation, the diaphragm 77 is displaced in a direction of decreasing a volume of the liquid sending chamber 76 due to an urging force of the first coil spring 80, and the liquid sending unit 71 performs an ejecting operation.

Subsequently, a configuration and an operation of the one-way valve on suctioning side 70 will be described.

As illustrated in FIG. 8, the one-way valve on suctioning side 70 is provided with a recessed portion on suctioning side 78*b* which is formed in a flow path forming member 78, a valve on suctioning side 82 with flexibility, and a fixing member on suctioning side 83 which fixes the valve on suctioning side 82 by being in contact with an outer edge portion of the valve on suctioning side 82. In addition, a second coil spring 84 is disposed between the valve on suctioning side 82 and the fixing member on suctioning side 83.

The one-way valve on suctioning side 70 is provided with a valve chamber on suctioning side 85 which is formed by being surrounded with the recessed portion on suctioning side 78*b* and the fixing member on suctioning side 83. The valve chamber on suctioning side 85 is partitioned into a portion on the upstream side and a portion on the downstream side using the valve on suctioning side 82, in which a downstream end of the connection portion 32 is connected to the portion on the upstream side, and an upstream end of the first flow path 27*a* is connected to the portion on the downstream side.

A through-hole 82*a* is formed at a center portion of the valve on suctioning side 82, and an annular protrusion portion 82*b* is formed at a position surrounding the through-hole 82*a* so as to face an inner bottom face of the recessed portion on suctioning side 78*b*. For this reason, the portion on the upstream side and the portion on the downstream side of the valve chamber on suctioning side 85 can communicate through the through-hole 82*a*.

As illustrated in FIG. 9, the second coil spring 84 urges the valve on suctioning side 82 in a direction in which the annular protrusion portion 82*b* comes into contact with the inner bottom face of the recessed portion on suctioning side 78*b*. That is, the valve on suctioning side 82 closes the liquid supply flow path 27 by preventing the portion on the upstream side and the portion on the downstream side of the valve chamber on suctioning side 85 from communicating with each other.

As illustrated in FIG. 8, when the liquid sending unit 71 performs a suctioning operation, liquid in the valve chamber on suctioning side 85 is suctioned inside the liquid sending chamber 76 through the first flow path 27*a*, and a negative pressure is generated at the portion on the downstream side of the valve chamber on suctioning side 85. Then, the valve on suctioning side 82 is displaced against an urging force of the second coil spring 84, the annular protrusion portion 82*b* is separated from the inner bottom face of the recessed portion on suctioning side 78*b*, and the portion on the upstream side and the portion on the downstream side of the valve chamber on suctioning side 85 communicate with each other. That is, the one-way valve on suctioning side 70 is closed, and the liquid supply flow path 27 is opened. In this manner, liquid in the liquid accommodating unit 21 is supplied toward the liquid sending unit 71 side through the connection portion 32.

Meanwhile, as illustrated in FIG. 9, when the liquid sending unit 71 performs an ejecting operation, liquid in the liquid sending chamber 76 flows into the valve chamber on suctioning side 85 through the first flow path 27*a*. In this manner, the negative pressure in the valve chamber on suctioning side 85 is relieved, and the annular protrusion portion 82*b* of the valve on suctioning side 82 comes into contact with the inner bottom face of the recessed portion on suctioning side 78*b* due to the urging force of the second coil spring 84. That is, the one-way valve on suctioning side 70 is closed.

Subsequently, a configuration and an operation of the one-way valve on ejecting side 72 will be described.

As illustrated in FIG. 8, the one-way valve on ejecting side 72 is provided with a valve chamber on ejecting side 88 which is formed by being surrounded by a recessed portion on ejecting side 78*c* which is formed in the flow path forming member 78 and a film member 87. A valve on ejecting side 89 with flexibility and a fixing member on ejecting side 90 which fixes the valve on ejecting side 89 by being in contact with an outer edge portion of the valve on ejecting side 89 are provided inside the valve chamber on ejecting side 88. In addition, valve chamber on ejecting side 88 configures a part of the liquid supply flow path 27, and in which a downstream end of the second flow path 27*b* and an upstream end of the third flow path 27*c* are connected. An opening of the second flow path 27*b* with respect to the valve chamber on ejecting side 88 is usually closed by an abutting portion 89*a* of the valve on ejecting side 89.

As illustrated in FIG. 8, since liquid in the valve chamber on ejecting side 88 is suctioned to the liquid sending unit 71 side through the second flow path 27*b* when the liquid sending unit 71 performs a suctioning operation, the abutting portion 89*a* closes the second flow path 27*b*. That is, the one-way valve on ejecting side 72 is closed.

As illustrated in FIG. 9, since liquid in the liquid sending chamber 76 is ejected in a pressurized state when the liquid sending unit 71 performs an ejecting operation, the abutting portion 89*a* is displaced so as to be separated from the opening of the second flow path 27*b* due to a pressurizing force of the liquid. That is, the one-way valve on ejecting side 72 is opened, and opens the liquid supply flow path 27. Then, liquid flows into the valve chamber on ejecting side 88 through the second flow path 27*b*, and the liquid which flows in is supplied to the buffer 73 through the third flow path 27*c*.

Subsequently, a configuration and an operation of the buffer 73 will be described.

Figure 10:
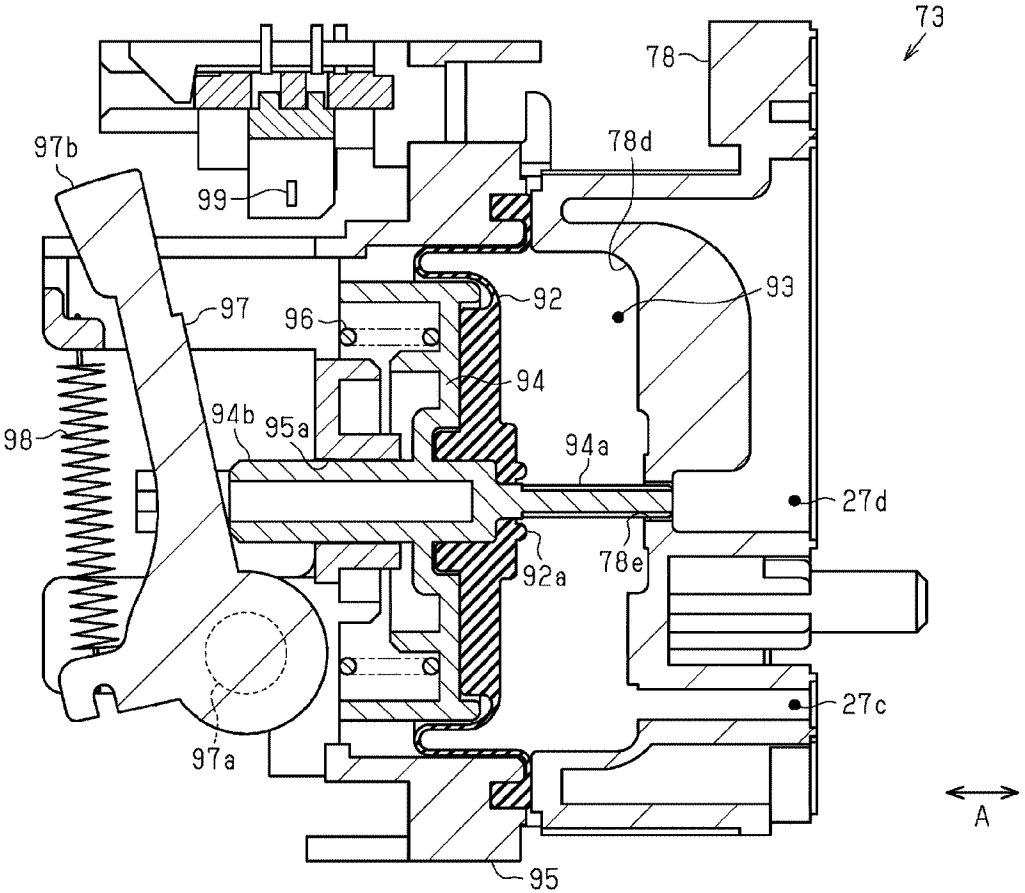
FIG. 10 is a sectional view of a buffer provided in the flow path unit in FIG. 5.

As illustrated in FIG. 10, the buffer 73 includes a liquid chamber 93 which is formed by being surrounded with a recessed portion for buffer 78*d* which is formed in the flow path forming member 78, and a flexible member 92. The liquid chamber 93 configures a part of the liquid supply flow path 27, and in which a downstream end of the third flow path 27*c* and an upstream end of the fourth flow path 27*d* are connected. That is, the liquid supply flow path 27 is configured by including the liquid chamber 93 partly formed by a flexible member 92, and the flow path unit 33 includes the liquid chamber 93. In addition, when the liquid sending unit 71 performs a suctioning operation and an ejecting operation, liquid is sent to the liquid ejecting head 38 from the liquid accommodating unit 21 on the upstream side from the liquid chamber 93.

The buffer 73 is provided with a displacing member 94 which is connected to the flexible member 92, and is displaced along with the flexible member 92, a fixing member 95 which fixes the flexible member 92 by being in contact with an outer edge portion of the flexible member 92, and a first urging member 96 as a coil spring, or the like, for example, which is disposed between the displacing member 94 and the fixing member 95.

The displacing member 94 is provided on an outer face on a side opposite to an inner face which configures the liquid chamber 93 of the flexible member 92. In addition, the first urging member 96 urges the flexible member 92 in a direction in which a volume of the liquid chamber 93 is reduced, by urging the displacing member 94.

The displacing member 94 is provided with a first guided portion 94*a* which protrudes inside the liquid chamber 93 along a displacing direction A, and a second guided portion 94*b* which protrudes on a side opposite to the liquid chamber 93. In addition, a first guide portion 78*e* which guides the first guided portion 94*a* in the displacing direction A of the flexible member 92 is formed in flow path forming member 78. A second guide portion 95*a* which guides the second guided portion 94*b* in the displacing direction A is formed in the fixing member 95. That is, the flow path unit 33 includes the guide portions 78*e* and 95*a*, and the guided portions 94*a* and 94*b*, and the guided portions 94*a* and 94*b* are connected to the flexible member 92, and are displaced along with the flexible member 92.

The first guided portion 94*a* is provided in a shaft shape so as to protrude on the liquid chamber 93 side from approximately a center position of the flexible member 92 which is formed in an approximately disc shape. In addition, the first guide portion 78*e* is formed in a hole shape in the recessed portion for buffer 78*d*, and is configured so that the first guided portion 94*a* is inserted thereto.

It is preferable that the first guided portion 94*a* be set to a bar-shaped column including one or a plurality of recessions which extend so as to go along the displacing direction A, for example, and a part of the fourth flow path 27*d* is configured due to an interval between the circular hole-shaped first guide portion 78*e* and the first guided portion 94*a*. In addition, the flexible member 92 includes a closing portion 92*a* which protrudes in an annular shape at a position surrounding the first guided portion 94*a*.

Figure 11:
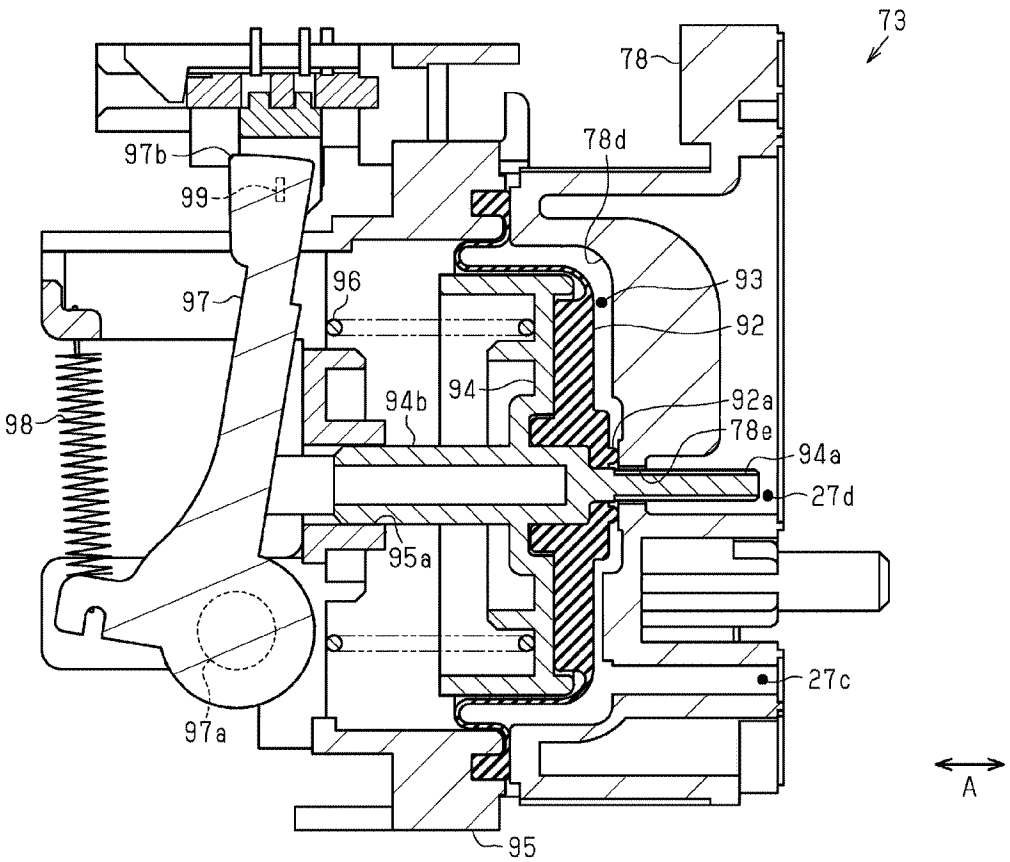
FIG. 11 is a sectional view of the buffer in a state in which the liquid supply path is closed.

It is preferable that the first guided portion 94*a* be set to a length obtained when the first guided portion 94*a* is engaged with the first guide portion 78*e*, in a case in which the flexible member 92 is located at the most distant position from the first guide portion 78*e*, and the liquid chamber 93 has the largest volume. In addition, as illustrated in FIG. 11, it is preferable that the second guided portion 94*b* be set to a length obtained when the second guided portion 94*b* is engaged with the second guide portion 95*a*, in a case in which the flexible member 92 is located at the most distant position from the second guide portion 95*a*, and the liquid chamber 93 has the smallest volume. By configuring in this manner, it is possible to reduce a concern that the guided portions 94*a* and 94*b* may be deviated from the guide portions 78*e* and 95*a*.

As illustrated in FIG. 11, a closing portion 92*a* closes the liquid supply flow path 27 when the flexible member 92 is displaced in a direction in which a volume of the liquid chamber 93 is reduced, and is in contact with the recessed portion for buffer 78*d* as a wall of the liquid chamber 93. That is, the flexible member 92 prevents the liquid chamber 93 and the fourth flow path 27*d* from communicating with each other by surrounding the first guide portion 78*e* with the closing portion 92*a*.

As illustrated in FIG. 10, the flow path unit 33 is provided with a lever portion 97 which is provided so as to rotate around a shaft 97*a*, a second urging member 98 which urges the lever portion 97, and a displacement detecting unit 99 which detects a displacement of the flexible member 92 by detecting a portion to be detected 97*b* included in the lever portion 97. The second urging member 98 in the embodiment is a tension spring, and the displacement detecting unit 99 is an optical sensor which includes a light emitting portion and a light receiving portion.

As illustrated in FIG. 10, the lever portion 97 rotates against an urging force of the second urging member 98 by being pressed by the second guided portion 94*b*, and is set to a non-detecting posture in which the portion to be detected 97*b* is not detected by the displacement detecting unit 99. In addition, as illustrated in FIG. 11, the lever portion 97 is set to a detecting posture in which the portion to be detected 97*b* is detected by the displacement detecting unit 99 in a state of not being pressed by the second guided portion 94*b*.

Subsequently, in the liquid ejecting apparatus 11 which is configured as described above, particularly, an operation of the buffer 73 included in the flow path unit 33 will be described. In addition, the liquid sending unit 71 is a unit which alternately performs a suctioning operation and an ejecting operation, continuously.

As illustrated in FIGS. 8 and 10, since liquid is supplied to the liquid chamber 93 through the third flow path 27*c* when the liquid sending unit 71 performs an ejecting operation, the flexible member 92 is displaced on the fixing member 95 side against an urging force of the first urging member 96 due to a pressurizing force of the liquid. That is, the flexible member 92 is displaced so as to increase a volume of the liquid chamber 93, and the displacing member 94 sets the lever portion 97 to a non-detecting posture by pressing the lever member.

When liquid is ejected from the liquid ejecting head 38, and is consumed, liquid in the liquid chamber 93 flows out to the fourth flow path 27*d*. Since the liquid supply flow path 27 includes the liquid chamber 93 of which a volume is variable, liquid can be supplied to the liquid ejecting head 38 while the liquid sending unit 71 performs a suctioning operation. In addition, when the liquid sending unit 71 performs an ejecting operation, a quantity of liquid which flows out is supplied to the liquid chamber 93 from the liquid sending unit 71, and the liquid chamber 93 is maintained at a state of communicating with the fourth flow path 27*d*.

Meanwhile, when a residual quantity of liquid accommodated in the liquid accommodating unit 21 enters an end state in which liquid is reduced to a quantity which is not sufficient for performing printing, liquid is not supplied from the liquid accommodating unit 21. Then, a volume of the liquid chamber 93 is reduced by a quantity of liquid which flows out to the fourth flow path 27*d*.

That is, as illustrated in FIG. 11, the flexible member 92 reduces a volume of the liquid chamber 93 by being displaced so as to get close to the recessed portion for buffer 78*d*. At this time, the lever portion 97 is set to a detecting posture, and the displacement detecting unit 99 outputs a detecting signal which is obtained by detecting the portion to be detected 97*b* to the control unit 29. In addition, the control unit 29 informs a user of end information which denotes that the liquid accommodating unit 21 enters an end state, by displaying the end information on the operation panel 19, for example.

Subsequently, an operation in a case in which suctioning cleaning of the liquid ejecting head 38 is performed by the maintenance unit 26 will be described. The supply mechanism 28 is maintained at a non-driving state in which the pressure changing chamber 75 is opened to atmosphere. That is, a non-driving state of the liquid sending unit 71 is a state in which a suctioning operation is not performed. For this reason, the liquid sending unit 71 in the non-driving state performs an ejecting operation until the diaphragm 77 comes into contact with the recessed portion for sending liquid 78*a* in a case of being located at a position separated from the recessed portion for sending liquid 78*a*, and stops the operation after the diaphragm 77 comes into contact with the recessed portion for sending liquid 78*a*.

Meanwhile, when the suctioning unit 51 is driven in a state in which the cap 49 comes into contact with the liquid ejecting head 38, liquid is discharged from the nozzle 37, and liquid in the liquid chamber 93 flows out to the fourth flow path 27*d*. In addition, a quantity of liquid which flows out is supplied to the liquid chamber 93 from the liquid sending unit 71.

As illustrated in FIG. 11, when the diaphragm 77 of the liquid sending unit 71 comes into contact with the recessed portion for sending liquid 78*a*, and liquid is not supplied from the liquid sending unit 71, a volume of the liquid chamber 93 is reduced by a quantity of liquid which flows out to the fourth flow path 27*d*. That is, the flexible member 92 closes the liquid supply flow path 27 by being displaced in a direction in which the volume of the liquid chamber 93 is reduced due to a decrease in liquid in the liquid chamber 93, when liquid is suctioned using the suctioning unit 51 in a non-driving state of the liquid sending unit 71.

In addition, negative pressures in the liquid supply flow path 27 on the downstream side of the fourth flow path 27*d*, and in the liquid ejecting head 38 are increased when suctioning, using the suctioning unit 51 is continued in a state in which the liquid supply flow path 27 is closed by the flexible member 92. The buffer 73 is maintained at a state of closing the liquid supply flow path 27, since the one-way valve on ejecting side 72 is opened when the liquid sending unit 71 performs a suctioning operation in this state. In addition, when the liquid sending unit 71 sends liquid therefrom, by performing an ejecting operation after a suctioning operation, liquid flows into the liquid chamber 93 of the buffer 73 through the third flow path 27*c*, and the flexible member 92 is displaced in a direction of increasing the volume of the liquid chamber 93. That is, the flexible member 92 opens the liquid supply flow path 27 when the liquid sending unit 71 is driven in a state in which liquid is suctioned by the suctioning unit 51, and closes the liquid supply flow path 27.

In this manner, a closed state of the liquid supply flow path 27 is relieved, and bubbles, thickened liquid, or the like, which remains inside the liquid ejecting head 38 is discharged with great force through the nozzle 37 along with liquid send from the liquid sending unit 71. That is, so-called chock cleaning is performed, using the maintenance unit 26 and the buffer 73.

According to the above-described embodiment, it is possible to obtain the following effects.

(1) Since the liquid supply flow path 27 is closed, using the flexible member 92 as a detecting target of the displacement detecting unit 99, and which configures a part of the liquid chamber 93, it is possible to prevent a configuration of the liquid supply flow path 27 from being complicated, compared to a case of providing a configuration for closing the liquid supply flow path 27 separately.

(2) Since the guided portions 94*a* and 94*b* which are connected to the flexible member 92 are guided by the guide portions 78*e* and 95*a* in the displacing direction A of the flexible member 92, it is possible to make a displacement of the flexible member 92 stable. Accordingly, it is possible to stably close the liquid supply flow path 27 using the flexible member 92.

(3) The closing portion 92*a* included in the flexible member 92 closes the liquid supply flow path 27 at a position of surrounding the first guide portion 94*a*. That is, since it is possible to determine a position of closing the liquid supply flow path 27, it is possible to stably perform closing of the liquid supply flow path 27.

(4) It is possible to perform cleaning of the liquid ejecting head 38 using the suctioning unit 51 which suctions liquid from the liquid ejecting head 38. In addition, since it is possible to close the liquid supply flow path 27 using the suctioning, an increase in the number of components can be suppressed, compared to a case of separately providing a mechanism for closing the liquid supply flow path 27.

(5) When liquid is suctioned by the suctioning unit 51, and the liquid supply flow path 27 is closed, a negative pressure in the liquid supply flow path 27 increases. In addition, when opening the liquid supply flow path 27 by driving the liquid sending unit 71 in this state, it is possible to make liquid flow with great force.

(6) Since the flow path unit 33 includes the connection portion 32 and the engaging portion 55, it is possible to make a structure of the mounting unit 14 on which the liquid accommodating unit 21 is mounted simple. For this reason, it is possible to easily make a color of liquid which is accommodated, a quantity of liquid to be accommodated, or the like, correspond to a liquid accommodating unit 21 of a different type.

(7) Since the flow path unit 33 includes the substrate connection portion 56 connected to the circuit board 64 which is included in the liquid accommodating unit 21, it is possible to make a structure of the mounting unit 14 on which the liquid accommodating unit 21 is mounted simple. For this reason, it is possible to make a color of liquid which is accommodated, a quantity of liquid to be accommodated, or the like, correspond to a liquid accommodating unit 21 of a different type.

(8) Since bubbles in the liquid chamber 93 are discharged along with liquid when performing chock cleaning, bubbles in the liquid chamber 93 are reduced, and it is possible to improve detection accuracy of the displacement detecting unit 99. Accordingly, it is possible to improve accuracy when detecting a residual quantity in a case in which a residual quantity of liquid accommodated in the liquid accommodating unit 21 is detected, using a displacement of the flexible member 92.

The above-described embodiment can be changed like the following modification example. In addition, the above-described embodiment and the following example may be arbitrarily combined.

Figure 12:
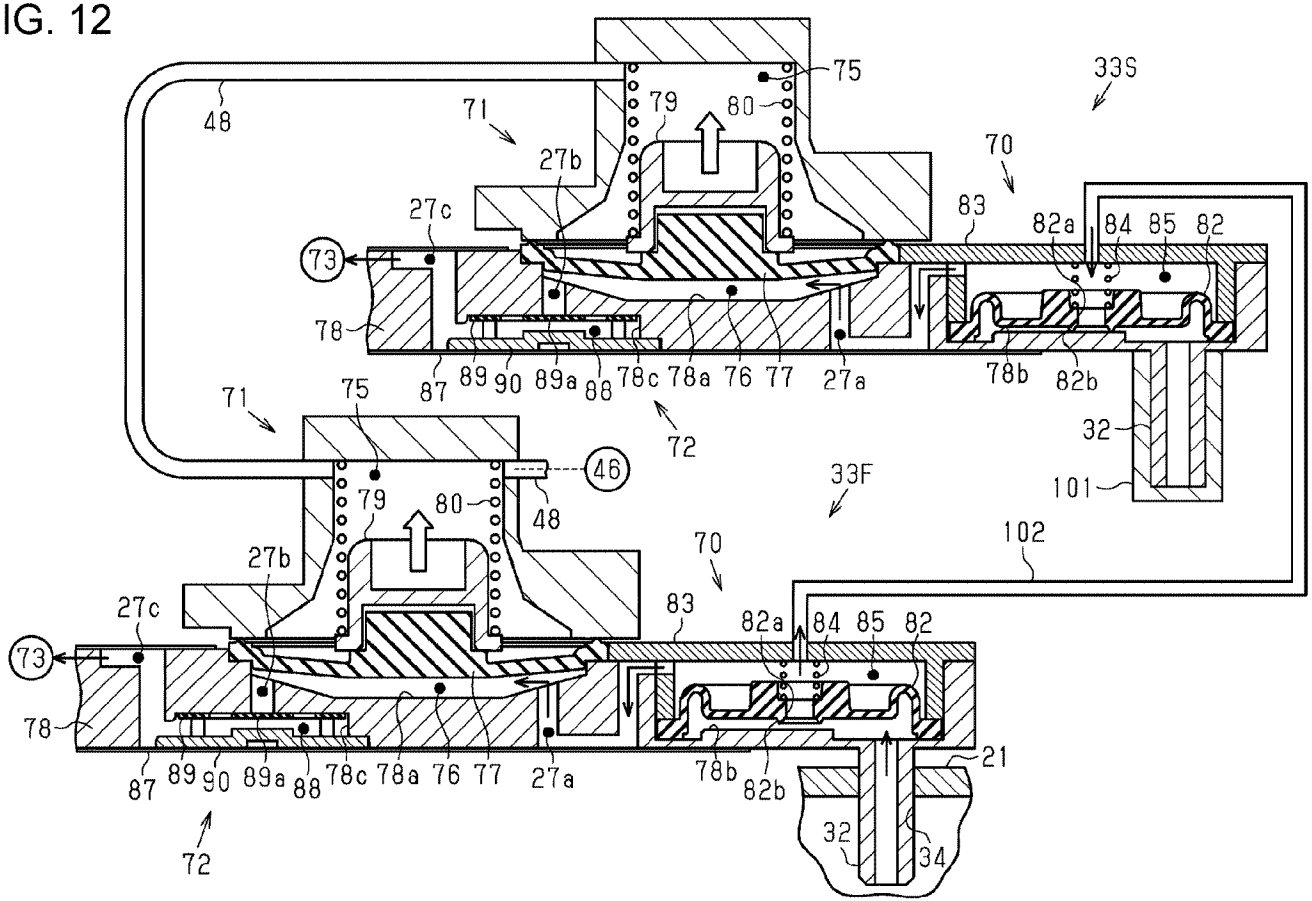
FIG. 12 is a schematic view of a flow path unit in a first modification example.

As illustrated in FIG. 12, liquid accommodated in one liquid accommodating unit 21 may be supplied to the liquid ejecting head 38 using the plurality of flow path units 33 (first modification example). That is, for example, the liquid accommodating unit 21 is connected to a connection portion 32 of a first flow path unit 33F, and a connection portion 32 of a second flow path unit 33S is sealed with a sealing member 101. In addition, portions of the first flow path unit 33F and the second flow path unit 33S on the upstream side from a valve chamber on suctioning side 85 are connected by a tube-shaped connecting member 102, and the pressure changing chambers 75 are connected by the pressure changing flow path 48.

When the pressure changing mechanism 46 is driven, each pressure changing chamber 75 enters a negative pressure state, and each liquid sending unit 71 performs a suctioning operation. Then, the one-way valve on suctioning side 70 of the first flow path unit 33F is opened, and liquid is suctioned from the liquid accommodating unit 21. Meanwhile, in the second flow path unit 33S, liquid flows into the valve chamber on suctioning side 85 through the connecting member 102, and liquid flows into the liquid sending chamber 76 while maintaining the one-way valve on suctioning side 70 at a closed state. In addition, when each liquid sending unit 71 performs an ejecting operation, liquid is supplied to the liquid ejecting head 38 through the one-way valve on ejecting side 72 and the buffer 73, from each liquid sending chamber 76 of the first flow path unit 33F and the second flow path unit 33S.

For example, in a liquid ejecting apparatus which performs printing of a single color using a single color (for example, black), a consumption speed of liquid of one color becomes high compared to a liquid ejecting apparatus which performs color printing using a plurality of colors. In this point, a speed of supplying liquid to the liquid ejecting head 38 is increased, and it is possible to suppress a decrease in throughput, by supplying liquid of one type to the liquid ejecting head 38 using a plurality of flow path units 33 in this manner.

The flow path unit 33 may not include the substrate connection portion 56. For example, the substrate connection portion 56 may be provided in the mounting unit 14. In addition, the liquid accommodating unit 21 may not include the circuit board 64.

The flow path unit 33 may not include the connection portion 32. For example, the connection portion 32 may be provided in the mounting unit 14. In addition, the connection portion 32 and the flow path unit 33 may be connected.

The flow path unit 33 may not include the engaging portion 55. For example, the engaging portion 55 may be provided in the mounting unit 14. In addition, a configuration of the engaging portion 55 may be arbitrarily changed. For example, the engaging portion 55 is set to an elastic member like a plate spring which has elasticity, and may be engaged with the liquid accommodating unit 21 in a case in which the liquid accommodating unit 21 is mounted on the mounting unit 14.

The liquid ejecting apparatus 11 may not be provided with the suctioning unit 51. In addition, the liquid sending unit 71 may send liquid to the liquid ejecting head 38 by pressurizing the liquid accommodated in the liquid accommodating unit 21. For example, pressurizing cleaning in which liquid is supplied from the liquid sending unit 71, and the liquid is discharged from the liquid ejecting head 38 may be performed.

In the suctioning cleaning performed by the maintenance unit 26, a suctioning operation and an ejecting operation may be performed, by driving the liquid sending unit 71 after stopping suctioning, using the suctioning unit 51. In addition, a configuration may be adopted, in which the suctioning unit 51 is caused to suction liquid in a state in which the pressure changing chamber 75 is set to a negative pressure state by driving the supply mechanism 28.

The flow path unit 33 may have a configuration in which the first guide portion 78*e* and the first guided portion 94*a*, and second guide portion 95*a* and the second guided portion 94*b* are not provided, and may have a configuration of being provided with any one thereof. In addition, the guide portions 78*e* and 95*a* may be arbitrarily changed when it is possible to guide the guided portions 94*a* and 94*b* in the displacing direction A. For example, a guided portion which is guided with respect to a rail-shaped guide portion may be provided in the flexible member 92.

The closing portion 92*a* may be provided at a position different from a position of surrounding the first guided portion 94*a*. The closing portion 92*a* may not protrude from the flexible member 92. In addition, a configuration may be adopted, in which an annular protrusion portion is formed at a position surrounding the first guide portion 78*e* of the recessed portion 78*d* for buffer, and the liquid supply flow path 27 is closed by causing the flexible member 92 to come into contact with the annular protrusion portion.

A configuration in which, in the liquid accommodating unit 21, the container 13 and the liquid accommodating body 20 are integrally formed, and the liquid accommodating unit is a cartridge which is exchanged when accommodated liquid is consumed may be adopted.

Liquid ejected from a liquid ejecting unit is not limited to ink, and may be a liquid body obtained by dispersing or mixing particles of a functional material in liquid, for example. For example, a configuration may be adopted, in which a liquid body including a material such as an electrode material which is used when manufacturing a liquid crystal display, an electroluminescence (EL) display, and a surface light emission display, or a coloring material (pixel material) in a form of dispersion or dissolution is ejected, and recording is performed.

The medium S is not limited to a sheet, may be a plastic film, a thin plate material, or the like, and may be cloth which is used in a textile printing apparatus, or the like. The medium S may be a cut sheet which is cut into a predetermined size, may be a roll-shaped medium which is wound in a cylindrical shape, for example, may be a cloth in an arbitrary shape, or the like, such as T-shirts, and may be a three-dimensional object formed in an arbitrary shape such as tableware, or stationery.

The entire disclosure of Japanese Patent Application No. 2016-167224, filed Aug. 29, 2016 is expressly incorporated by reference herein.

What is claimed is:

1. A liquid ejecting apparatus comprising:

a liquid ejecting head which ejects liquid from nozzles; and a liquid supply path which includes a liquid flow path unit and supplies the liquid to the liquid ejecting head;

wherein the flow path unit includes a liquid chamber partly formed by a flexible member, a displacing member connected to the flexible member and displaced with the flexible member, a guide portion guiding the displacing member in a displacing direction of the flexible member, and a displacement detecting unit which detects a displacement of the flexible member, wherein the displacing member includes a first guided portion which protrudes inside the liquid chamber along the displacing direction and a second guided portion which protrudes on a side opposite to the liquid chamber, wherein the guide portion guides the first guided portion of the displacing member, wherein the displacement detecting unit detects the displacement of the flexible member by detecting a displacement of the second guided portion, and wherein the flexible member closes the liquid supply path when the flexible member is displaced in a direction in which a volume of the liquid chamber is reduced.

2. The liquid ejecting apparatus according to claim 1, wherein a part of the liquid supply path is constituted by a gap between the guide portion and the first guided portion.

3. The liquid ejecting apparatus according to claim 1, wherein the first guided portion is provided in a shaft shape so as to protrude on the liquid chamber side from the flexible member, wherein the guide portion is configured so that the first guided portion is inserted into the guide portion, wherein the flexible member has an annular closing portion at a position surrounding the guided portion, and wherein the closing portion closes the liquid supply path when the flexible member is displaced in a direction of reducing a volume of the liquid chamber, and comes into contact with the liquid supply path.

4. The liquid ejecting apparatus according to claim 1, further comprising:

a suctioning unit which suctions the liquid from the liquid ejecting head, wherein the flow path unit further includes a liquid sending unit which sends the liquid to the liquid ejecting head from a liquid accommodating unit on the upstream side from the liquid chamber, and wherein the flexible member closes the liquid supply path when the liquid is suctioned by the suctioning unit in a state in which the liquid sending unit is set to a non-driving state.

5. The liquid ejecting apparatus according to claim 4, wherein the flexible member opens the liquid supply path when the liquid sending unit is driven in a state in which the liquid is suctioned by the suctioning unit and the liquid supply path is closed.

6. The liquid ejecting apparatus according to claim 1, wherein the flow path unit further includes a connection portion which is connected to a liquid accommodating unit which accommodates the liquid supplied to the liquid ejecting head, and an engaging portion which is engaged with the liquid accommodating unit, and wherein the connection portion and the engaging portion are respectively provided with respect to a plurality of liquid accommodating units.

7. The liquid ejecting apparatus according to claim 1, wherein the flow path unit further includes a substrate connection portion which is electrically connected to a circuit board of a liquid accommodating unit which accommodates the liquid supplied to the liquid ejecting head, and wherein the substrate connection portion is respectively provided with respect to the plurality of liquid accommodating units.

8. The liquid ejecting apparatus according to claim 1, wherein the flow path unit includes a liquid sending unit which sends the liquid to the liquid ejecting head from a liquid accommodating unit that accommodates the liquid, and wherein the liquid chamber is provided downstream from the liquid sending unit in the liquid supply path.

9. The liquid ejecting apparatus according to claim 1, wherein the liquid supply path has a lead-out flow path for leading the liquid of the liquid chamber to a downstream side, and wherein the lead-out flow path includes the guide portion.

10. The liquid ejecting apparatus according to claim 9, wherein the flexible member is configured to close the lead-out flow path.

11. The liquid ejecting apparatus according to claim 1, wherein the flow path unit includes a second guide portion guiding the second guided portion of the displacing member in a displacing direction of the flexible member.

* * * * *